United States Patent [19]

Mori

[11] Patent Number: 4,499,805

[45] Date of Patent: Feb. 19, 1985

[54] PUNCH FOR OFFICE USE

[75] Inventor: Chuzo Mori, Katsushika, Japan

[73] Assignee: Carl Manufacturing Co., Ltd., Tokyo, Japan

[21] Appl. No.: 393,890

[22] Filed: Jul. 1, 1982

[51] Int. Cl.[3] ..... B26F 1/02

[52] U.S. Cl. ..... 83/468; 83/568; 83/570; 83/588; 83/618

[58] Field of Search ..... 83/467, 468, 522, 588, 83/618, 633, 640, 856, 566–570

[56] References Cited

U.S. PATENT DOCUMENTS

| | | | |
|---|---|---|---|
| 1,875,720 | 9/1932 | Freeman | 83/567 |
| 2,323,431 | 7/1943 | Wales | 83/567 X |
| 3,041,908 | 7/1962 | Dubats | 83/570 X |
| 3,525,279 | 8/1970 | Christian | 83/568 X |
| 3,661,039 | 5/1972 | Lewis | 83/569 X |
| 3,677,117 | 7/1972 | Cutter | 83/618 X |
| 4,046,045 | 9/1977 | Stevens | 83/618 X |

*Primary Examiner*—Frank T. Yost
*Attorney, Agent, or Firm*—Parkhurst & Oliff

[57] ABSTRACT

A large punch for piercing a thick bundle of sheets of paper at a time. A gear mechanism is operationally associated with a handle to move vertically a pair of paper holding plates cooperating with a pair of cylindrical piercing blades provided on a base, and thereby reduces the force required for moving the handle for the piercing operation. A base plate, which has a pair of holes each defining a passage for one of the piercing blades, is vertically rotatably supported on the base, and is normally biased upwardly to facilitate removal of the piercing blades from a thick bundle of sheets of paper after it has been pierced. The piercing blades and the paper holding plates are removably attached to the base and the gear mechanism, respectively, so that both of them can be easily changed to new ones if required.

12 Claims, 9 Drawing Figures

26a
26b
25
24
24
24a
24b
20
26a
20
4
3
2
4
2
11
19
9
20
2
6
34a
7
20
2
6
30
44
33
7a
7c
35
5
3
7d
32
36
34
34a
1
8

29
29
27
31
30
28
32
28a 15
14
15

20
25
23
20
7
7
22
21
6
6
7b
7a

PUNCH FOR OFFICE USE

BACKGROUND OF THE INVENTION

1. Field of the Invention

This invention relates to a punch for office use, and more particularly, to a large-sized punch for office use.

2. Description of the Prior Art

In a large punch for office use, a large force is required for operating the handle of the punch to make holes in a thick stack of sheets of paper at the same time. It has been considered necessary to develop a punch which can be operated with a smaller force. It has also been found necessary to enable easy removal of piercing blades from a bundle of the sheets of paper after it has been punched. Moreover, the piercing blades and the paper holding plate cooperating with the blades for the punching operation became worn after a long period of use. It is highly desirable to ensure that any worn blade or paper holding plate can be easily changed to a new one.

SUMMARY OF THE INVENTION

It is an object of this invention to provide a punch having a structure that can be operated with a small force to pierce a thick bundle of sheets of paper at a time.

It is another object of this invention to provide a punch having piercing blades which can be easily removed from a thick bundle of sheets of paper after it has been punched.

It is still another object of this invention to provide a punch so constructed that its piercing blades and paper holding plate can be easily changed to new ones when they become worn after a long period of use.

Other objects and advantages of this invention will become apparent from the following detailed description, and the accompanying drawings.

DETAILED DESCRIPTION OF THE INVENTION

The punch of this invention is characterized by comprising a base, a hollow upstanding structural member provided at a tip end side of the base and having a gap portion from the base at its side corresponding to the side of the rear end of the base, a pair of cylindrical piercing blades upstandingly provided on the base forming the gap portion, a base plate for placing a thick stack of sheets of paper to be pierced thereon one end of which is pivoted at the side of the rear end of the base and the other end of which is formed with holes receiving respectively the pair of piercing blades and is spring-biased upwardly by a spring, a handle supported at one end thereof by a shaft which penetrates the upstanding structural portion and is rotatably supported thereto, said handle rotatably moving with respect to the base, gear means attached to the shaft supporting the handle, in the upstanding structural member, vertically movable gear means inserted into a portion of the upstanding structural member above the gap portion, having a rack engageable with the gear attached to the shaft, the vertically movable gear reciprocating with respect to the pair of piercing blades in cooperation with the handle through the gear attached to the shaft and the rack, and a pair of paper holding plates provided on the bottom of the vertically movable gear, respectively, corresponding to the pair of piercing blades so as to thrust against the ends of the piercing blades.

The invention will now be described more specifically with reference to the drawings showing a preferred embodiment which is in no way intended to limit the scope of this invention.

Figures 1, 2:
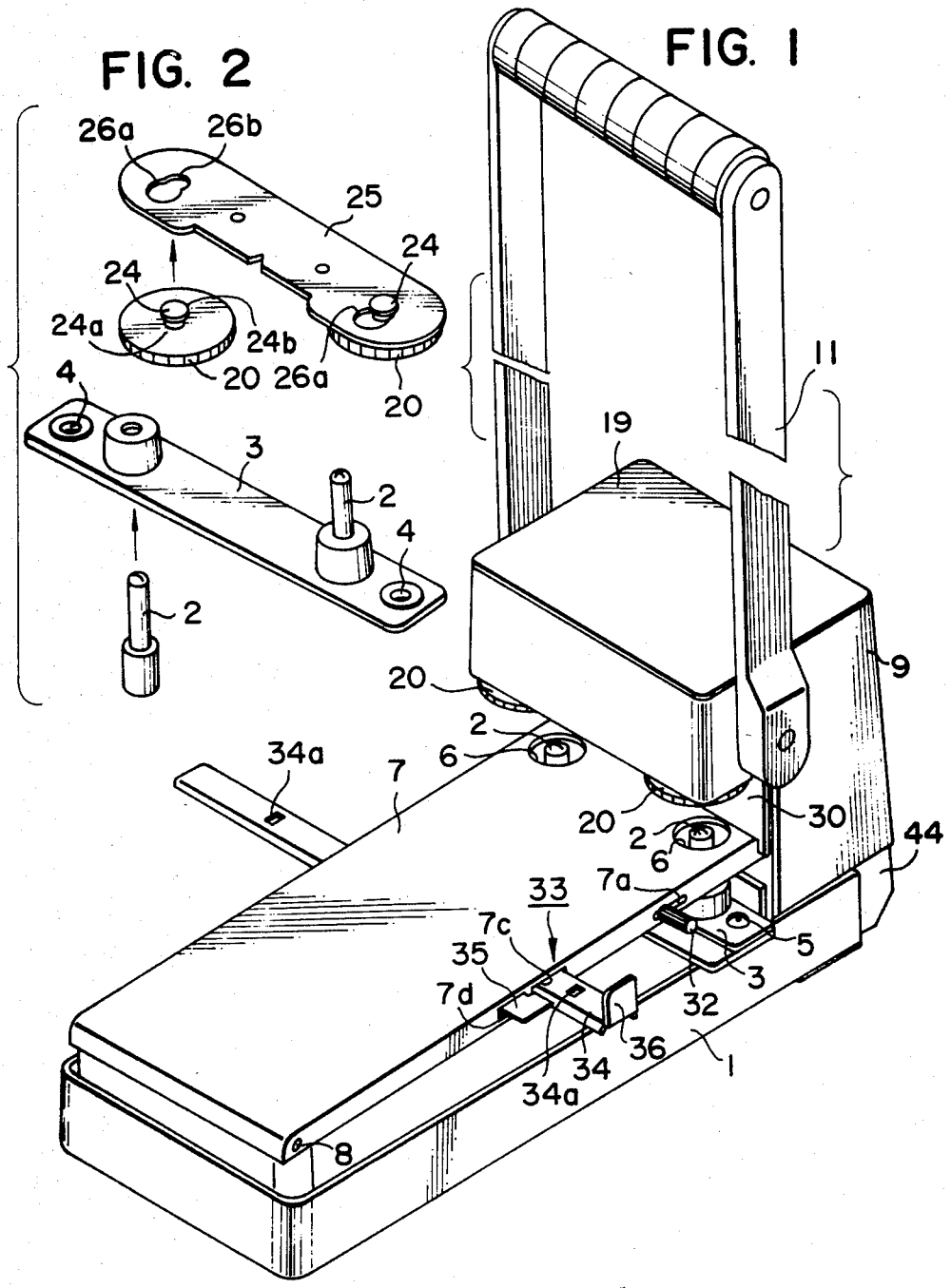
FIG. 1 is a perspective view of a punch embodying this invention.
FIG. 2 is an exploded perspective view of the piercing blades and the paper holding plates in the punch shown in FIG. 1.
Figure 3:
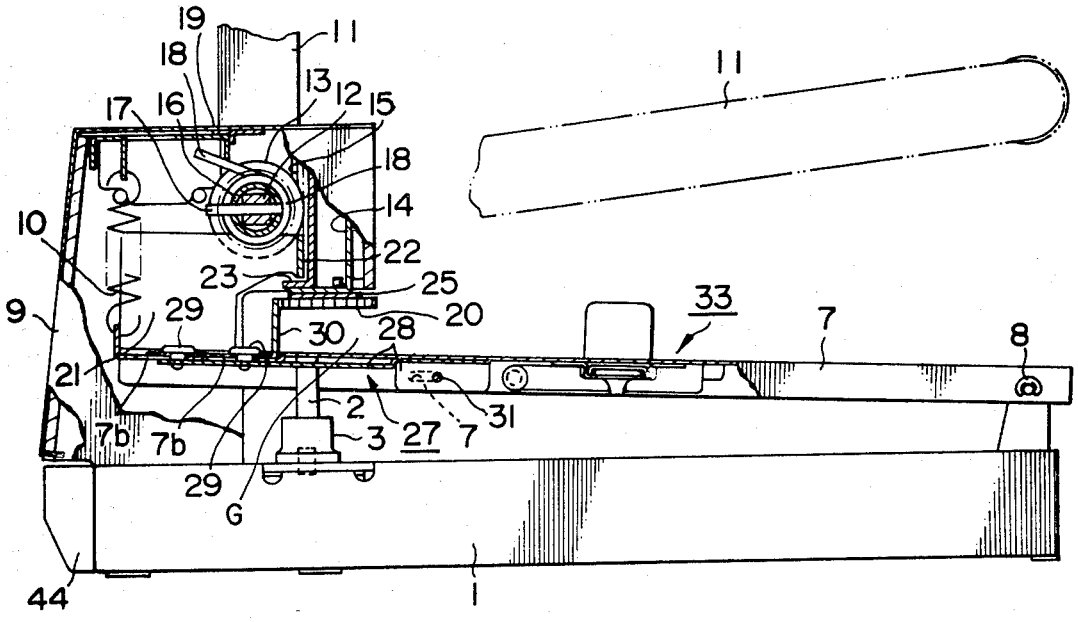
FIG. 3 is a fragmentary side elevational view, partly in section, of the punch shown in FIG. 1.
Figure 4:
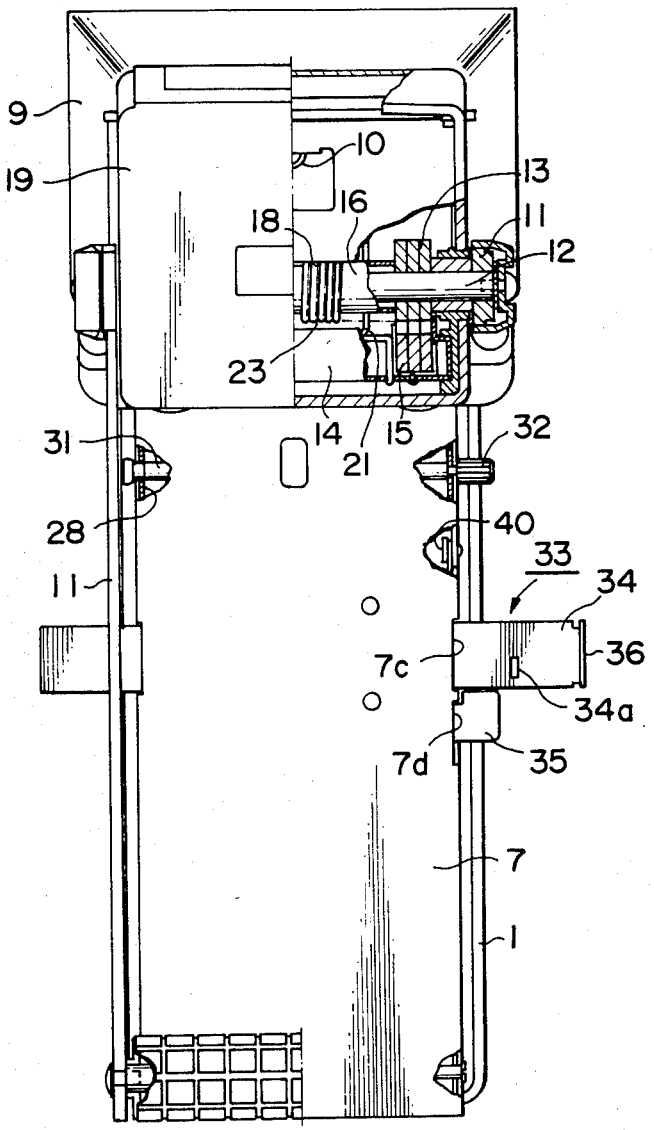
FIG. 4 is a fragmentary top plan view, partly in section, of the punch shown in FIG. 1, in which a handle is shown in its operative position.

Referring first to FIGS. 1, 3 and 4 of the drawings, there is shown a punch embodying this invention, and including a base 1 of the steel plate frame construction. A pair of cylindrical piercing blades 2 which are arranged upwardly are attached removably to the base 1 adjacent to one end thereof. The blades 2 are supported on a blade mounting plate 3 adjacent to the opposite ends thereof, as shown in FIG. 2. The mounting plate 3 has a pair of holes 4 in each of which a screw 5 (FIG. 1) is fitted to secure the mounting plate 3 detachably to the base 1. A base plate 7 is provided on the base 1, and secured vertically rotatable at a rear end side of the base 1 by a pin 8. The base plate 7 has a pair of holes 6 each defining a passage for one of the piercing blades 2.

A hollow upstanding structural member 9 is integrally formed on the one end of the base 1. A spring 10 extends between one end of the base plate 7 and an inner wall portion of the upstanding structural member 9 to normally bias the base plate 7, especially the tip side of the base plate, upwardly, as shown in FIG. 3. The member 9 is of the inverted L-shaped construction of a side elevational view. The upstanding structural member 9 has a gap portion G between its side corresponding to the side of the rear end of the base 1 and the base 1, and rotatably supports, at its upper portion, a shaft 12 penetrating in the width direction of the base 1, the handle 11 being supported at its end to the shaft in such a manner that the handle 11 straddles both ends of shaft 12.

A pair of gears 13 are provided on the shaft 12 fixing the handle 11 in the upstanding structural member 9, and engage with a pair of racks 15 of a vertically movable gear assembly 14 which is vertically and movably fitted to a portion of the upstanding structural member 9 above the gap portion G, as shown in FIGS. 3 and 4. Accordingly, if the handle 11 is tilted down, the gears 13 are rotated, and the racks 15 are, therefore, moved vertically to move the gear assembly 14 vertically. The relationship of gear 13 with the rack 15 reduces the manual force to be exerted on handle 11 for holding the paper during piercing operations. A tubular member 16 encircles the shaft 12 and is secured thereto by a screw rod 17. A coiled spring 18 encircles the tubular member 16, and has one end engaged with a portion of the top inner wall 19 of the upstanding structural member 9 to urge the handle 11 in a counter-clockwise direction in FIG. 3, i.e., in the direction which causes upward movement of the vertically movable gear assembly 14. The gear assembly 14 is of the frame construction as shown in FIGS. 3 to 5, and carries a pair of paper holding plates 20 at its lower end.

Figure 5:
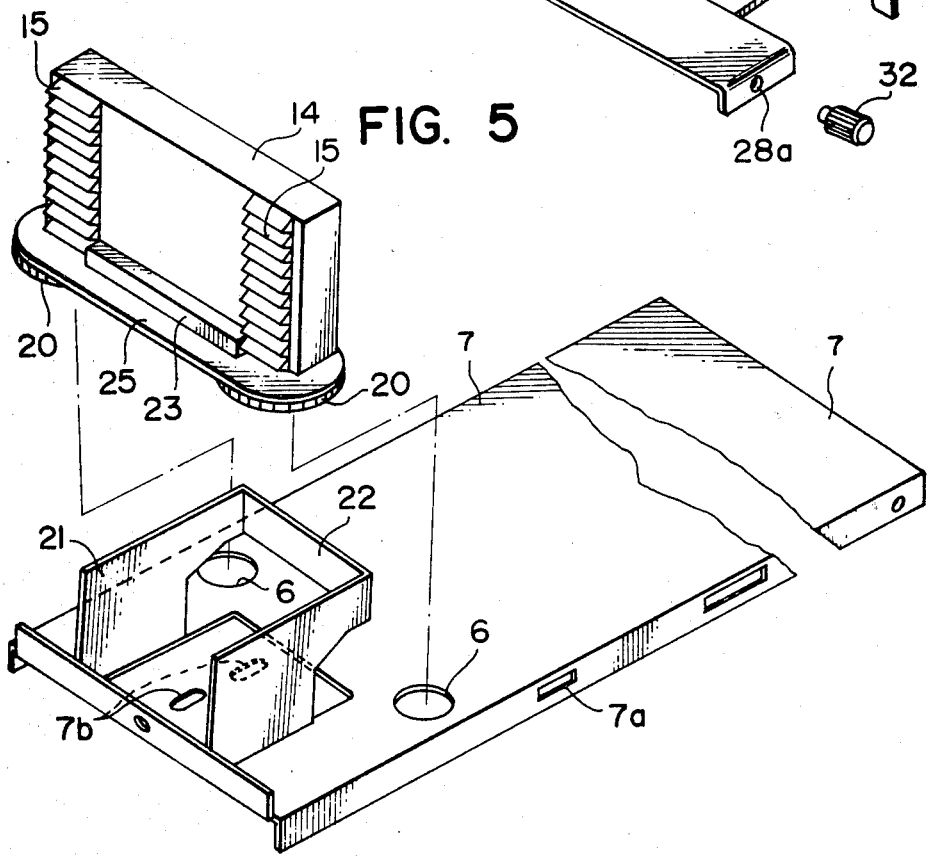
FIG. 5 is an exploded perspective view of the base plate and the vertically movable gear in the punch shown in FIG. 1.
Figure 7:
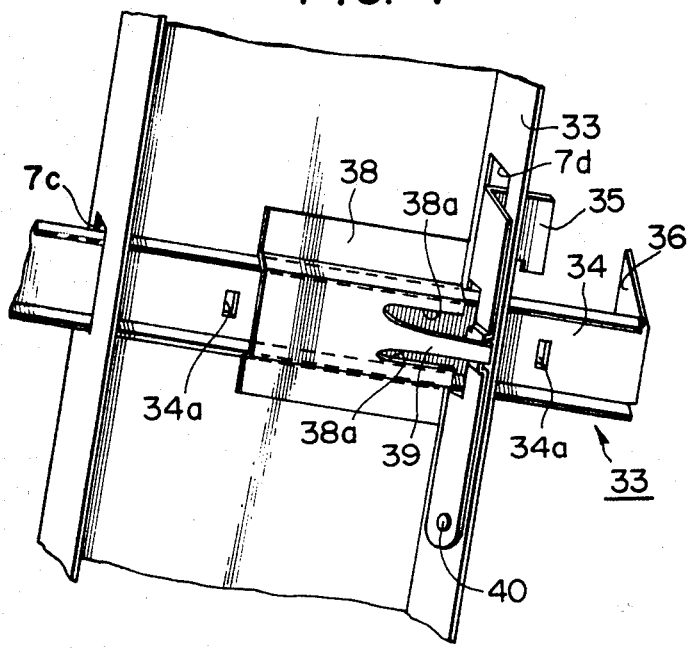
FIG. 7 is a fragmentary perspective view showing the underside of the base plate.
Figure 8:
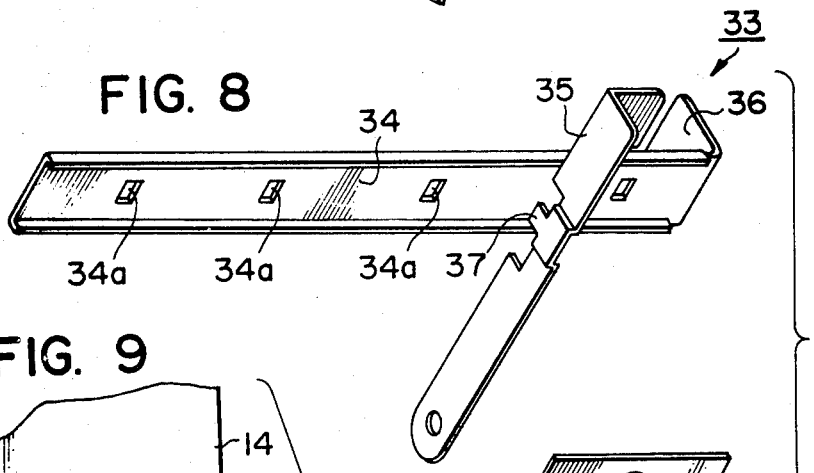
FIG. 8 is an exploded perspective view showing a transverse paper positioning member.

The base plate 7 comprises a plate having a pair of downwardly bent longitudinal edge portions in cross-section as shown in FIG. 5, and is provided at one end thereof with an upstanding member 21 of the inverted L-shaped construction in side elevation. The upstanding member 21 includes a horizontally projecting portion 22 which extends transversely of the base plate 7. The gear assembly 14 is formed adjacent to its bottom with a horizontal projection 23 above which the horizontally projecting portion 22 is positioned engageably therewith when the base plate 7 is in its uppermost position as shown in FIG. 3.

The paper holding plates 20 are each a disk of a material of, for example, polyethylene, polypropylene and so on which is lower in hardness than the cutting edges of the piercing blades 2, but which is sufficiently hard to hold under pressure the paper to be pierced. Each disk 20 has a notched circumferential edge, and is formed in the center of its upper surface with a projection 24 having a reduced diameter portion 24*a* terminating in an upper end portion 24*b* having an enlarged diameter, as shown in FIG. 2. A disk mounting plate 25 is attached to the bottom of the vertically movable gear assembly 14, and has a pair of holes each formed by a hole segment 26*a* which enables passage of the projection 24 on one of the paper holding plates 20 when the paper holding plate is attached to the mounting plate 25, or removed therefrom, and another hole segment 26*b* having a smaller diameter than the hole segment 26*a* so as to receive the reduced diameter portion of 24*b* of the projection 24 by moving the projection 24 from the hole segment 26*a*, and joined thereto for holding the projection 24 rotatably with its enlarged upper end portion 24*b* resting on the peripheral edge of the hole segment 26*b*.

Figure 6:
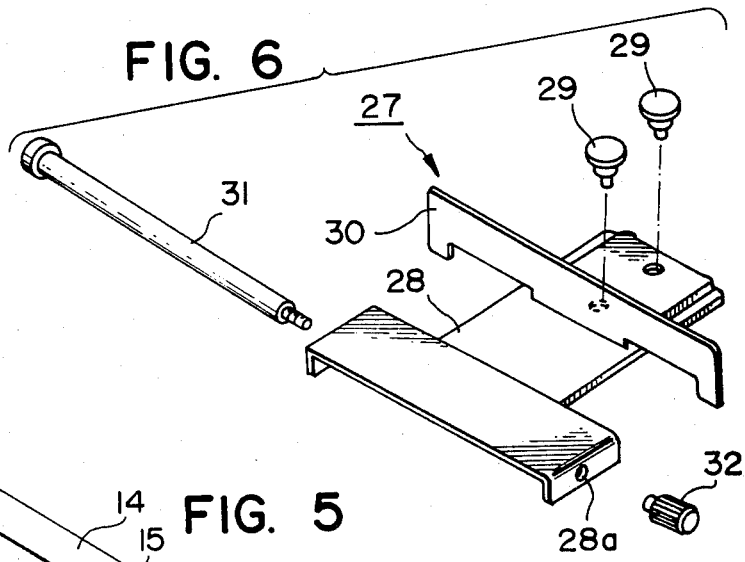
FIG. 6 is an exploded perspective view showing a longitudinal paper positioning member.

The punch also includes a longitudinal paper positioning mechanism 27 as shown in FIG. 3. It defines the position of one end of the paper to be pierced. As shown in detail in FIG. 6, the mechanism 27 comprises a movable plate 28 positioned on the underside of the base plate 7 adjacent to one end thereof, an upstanding stop member 30 secured to one end of the movable plate 28 by two rivets 29 extending through the base plate 7, and a shaft 31 extending transversely through the base plate 7 and the movable plate 28. The base plate 7 has a pair of elongated holes 7*a* in its downwardly bent longitudinal edge portions, and the movable plate 28 has a corresponding pair of holes 28*a* at the other end thereof. The shaft 31 extends through the holes 7*a* and 28*a*. The shaft 31 has an enlarged head as a stopper at one end, while a knob 32 is provided on the other end of the shaft 31. The base plate 7 has a pair of elongated holes 7*b* adjacent to one end thereof, as shown in FIGS. 3 and 5. The rivets 29 extend through the elongated holes 7*b*, and are movable therein, while the shaft 31 is movable in the elongated holes 7*a*, so that the integrated member of the movable plate 28 and the stop member 30 may be slideable longitudinally of the base plate 7. If it is necessary to change the distance between one end of the paper to be pierced, and the position at which a pair of holes are to be made in the paper, the knob 32 is moved to move the shaft 31 in the elongated holes 7*a* to thereby move the stop member 30 as required.

The punch also includes a transverse paper positioning mechanism 33 provided approximately in the mid-portion of the base plate 7. The base plate 7 has a pair of slots 7*c* formed in its downwardly bent longitudinal edge portions approximately in the mid-portion thereof, and a third slot 7*d* formed close to one of the slots 7*c*. A positioning strip 34 extends through the slots 7*c*, and is movable transversely of the base plate 7. A stop lever 35 has one end which projects through the slot 7*d*, and which can be pressed down. One end of the positioning strip 34 is upwardly bent to define an edge support 36 for the paper to be pierced. The strip 34 has a plurality of spaced apart apertures 34*a*. The lever 35 is disposed behind one of the downwardly bent longitudinal edge portions of the base plate 7, and has another end secured thereto by a pin 40 about which the lever 35 is rotatable. The lever 35 has an upwardly directed projection 37 which is engageable in one of the apertures 34*a* of the strip 34 located above the lever 35, whereby the strip 34 is locked against movement. The positions of the apertures 34*a* are so selected that the paper of various sizes, such as B4, A4, B5, A5 and B6, to be pierced may be accurately centered between the two piercing blades 2 when one longitudinal edge of the paper is held against the edge support 36. The mechanism 33 further includes a leaf spring 38 covering a portion of the strip 34, and secured to the underside of the base plate 7. The leaf spring 38 has at one end a pair of recesses 38*a* which define therebetween a hook projection 39 of appropriate strength engaged with a shoulder formed on the lever 35 to urge it upwardly so that the projection 37 thereof may be held in locking engagement with one of the apertures 34*a* in the positioning strip 34. If the lever 35 is pressed down, its projection 37 is disengaged from the strip 34 to render it movable. The mechanism 33, thus, facilitates transverse positioning of the paper to be pierced, and is also useful for shifting the paper transversely when it is necessary to form more than two holes therein.

In operation, the positioning strip 34 is appropriately moved to suit the paper to be pierced, while the longitudinal paper positioning mechanism 27 is also moved to suit the position at which the paper is pierced. A bundle of sheets of paper to be pieced is placed on the base plate 7, and one longitudinal or transverse edge thereof is held against the edge support 36, while one transverse or longitudinal edge thereof is held against the stop member 30. If the handle 11 is rotated clockwise in FIG. 3, i.e., tilted down, the gears 13 are rotated to lower the vertically movable gear assembly 14 to cause the paper holding the plates 20 to press down the paper to be pierced, and the base plate 7 together, whereupon the piercing blades 2 are pierced through the paper. Small circular fragments or waste of paper, which are produced by the piercing operation, drop along the hollow interiors of the blades 2, and may be collected in a waste tray 44 disposed slidably in the base 1 as shown in FIG. 3. Upon penetration of the blades 2 through the entire bundle of sheets to be pierced, their cutting edges abut on the paper holding plates 20. The surfaces of the plates 20, therefore, get worn or damaged after a long time of use of the punch. In such a case, the plates 20 may be slightly rotated to expose an unworn portion for abutment by the blades 2. The plates 20 are, therefore, eccentric to the blades 2. If the whole area of one surface of the plates 20 is worn, they can be reversed, and if their rear surfaces are totally worn, the plates 20 may be changed to new ones.

Figure 9:
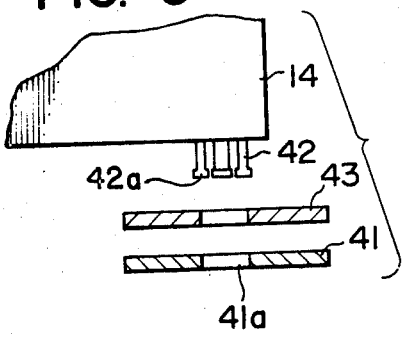
FIG. 9 is a fragmentary side elevational view, partly in section, showing a modified combination of the vertically movable gear and the paper holding plates.
Figure 9:
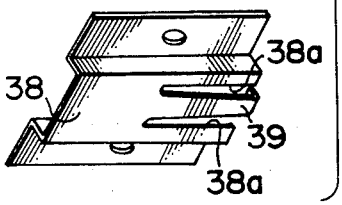

Referring now to FIG. 9, there is shown a modified paper holding plate 41 supported on the vertically movable gear assembly 14 in a different way. The plate 41 is a disk of polyethylene, polypropylene, or the like having a hole 41*a* in its center. A plurality of pins 42, having a protruded end 42*a* are formed from an elastic material, project downwardly from the bottom of the gear assembly 14, and are positioned to form a circle. The disk 41 is fitted about the pins 42, while a washer 43 is disposed between the assembly 14 and the disk 41.

Since the present invention has the above-mentioned construction, it is well suited for piercing a thick bundle of sheets of paper. Piercing operations can be readily conducted with a reduced force to be applied to the handle. The force required is reduced because the force applied to the handle is transmitted to the paper holding plate being lowered toward the piercing blades on the base through an increased force due to the operation of the gear attached to the shaft supporting the handle and the rack engaging said gear. After the paper has been punched, it can be easily removed from the piercing blades, since the base plate is raised when the handle is raised. This invention has the advantage that the piercing blades or the paper holding plates which become worn out after a long period of use, may be easily changed to new ones, so that the useful life of the punch can be extended.

What is claimed is:

1. A punch for office use comprising:

a base, having a tip end side and a rear end side, a hollow upstanding structural member provided at the tip end side of the base and having a gap portion from the base at its side corresponding to the side of the rear end of the base, a pair of stationary cylindrical piercing blades upstandingly provided on and fixedly secured to the base forming the gap portion, a base plate for placing a thick stack of sheets of paper to be pierced thereon having one end pivoted at the rear end side of the base, the other end having holes for receiving the pair of piercing blades, spring means connected to the other end of the base plate and the hollow upstanding structural member to upwardly bias the base plate, a handle supported on the upstanding structural member by a shaft which penetrates the upstanding structural member and is rotatably supported thereto, said handle rotatably movable with respect to the base, gear means attached to the shaft supporting the handle, said gear means located within the upstanding structural member, vertically movable gear means movable within a portion of the upstanding structural member above the gap portion, and engageable with the gear means attached to the shaft, said vertically movable gear means reciprocating with respect to the pair of piercing blades through the gear means attached to the shaft as the handle is moved, and a pair of paper holding plates provided on the bottom of the vertically movable gear means, corresponding to the pair of piercing blades so as to thrust against the ends of the piercing blades.

2. A punch for office use as claimed in claim 1, wherein the pair of piercing blades are detachably secured to the base.

3. A punch for office use as claimed in claim 2, wherein the pair of piercing blades is attached to a blade mounting plate secured detachably to the base.

4. A punch for office use as claimed in claim 1, wherein the pair of paper holding plates is disk shaped.

5. A punch for office use as claimed in claim 1, wherein the pair of paper holding plates is detachably provided on the bottom of the vertically movable gear means.

6. A punch for office use as claimed in claim 5, wherein the pair of paper holding plates is connected to a disk mounting plate detachably secured to the vertically movable gear means.

7. A punch for office use, as claimed in claim 6, wherein the disk mounting plate has at least one first hole segment and one second hole segment for receiving a projection means to secure the paper holding plate to the disk mounting plate, said second hole segment being joined with the first hole segment and having a smaller diameter than the first hole segment.

8. A punch for office use, as claimed in claim 7, wherein the paper holding plate has a projection extending from one surface of the plate, the projection having a reduced diameter portion and an enlarged diameter portion connected thereto, the enlarged diameter portion being received by the first hole segment of the disk mounting plate, and the reduced diameter portion being received by the second hole segment.

9. A punch for office use as claimed in claim 1, wherein the pair of paper holding plates has a hole extending through the center of the plate, and each paper holding plate is disk shaped.

10. A punch for office use as claimed in claim 9, wherein the bottom surface of the vertically movable gear means is provided with a plurality of pins made of elastic material and having protruded ends downwardly projected, said pins being inserted in the hole of the paper holding plates.

11. A punch as claimed in claim 1, further including a mechanism for defining the position of one longitudinal edge of the paper to be pierced by contacting a transverse edge of the paper thereto, said mechanism being attached to said base plate, and movable in a direction toward or away from said blades.

12. A punch for office use as claimed in claim 1 or claim 11, further including a mechanism for defining the position of a transverse edge of said paper to be pierced, said transverse edge defining mechanism being attached to said base plate, and comprising:

a positioning strip extending transversely of said base plate and provided movably in a direction connecting the pair of piercing blades, with at least one end bent upwardly, said strip having a plurality of apertures which are spaced apart from one another in the movable direction, and a lever provided on the backside of the base plate, and having a projection which is biased by a leaf spring and engaged in one of said apertures, said lever capable of being lowered against the force of said spring to having said projection thereof disengaged from said one aperture in which the projection is inserted to render said strip movable transversely of said base plate.

* * * * *